US008481157B2

(12) United States Patent
Wilson et al.

(10) Patent No.: US 8,481,157 B2
(45) Date of Patent: Jul. 9, 2013

(54) MELT EXTRUDED FIBERS AND METHODS OF MAKING THE SAME

(75) Inventors: Bruce B. Wilson, Woodbury, MN (US); Roger J. Stumo, Shoreview, MN (US); Stanley C. Erickson, Scandia, MN (US); William J. Kopecky, Hudson, WI (US); James C. Breister, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 257 days.

(21) Appl. No.: 11/668,687

(22) Filed: Jan. 30, 2007

(65) Prior Publication Data

US 2007/0154708 A1 Jul. 5, 2007

Related U.S. Application Data

(63) Continuation-in-part of application No. 10/851,340, filed on May 21, 2004, now Pat. No. 7,476,352.

(51) Int. Cl.
*D02G 3/00* (2006.01)

(52) U.S. Cl.
USPC ..... 428/364; 428/357

(58) Field of Classification Search
USPC ..... 428/357, 364
See application file for complete search history.

(56) References Cited

U.S. PATENT DOCUMENTS

| | | | | |
|---|---|---|---|---|
| 2,273,638 | A | 2/1942 | Graves et al. | |
| 2,365,374 | A | 12/1944 | Bailey | |
| 2,365,375 | A | 12/1944 | Bailey et al. | |
| 2,393,452 | A | 1/1946 | Bailey et al. | |
| 2,443,289 | A | 6/1948 | Bailey | |
| 3,101,990 | A * | 8/1963 | Heighton | 264/290.7 |
| 3,382,535 | A | 5/1968 | Ferrari | |
| 3,537,135 | A | 11/1970 | Santangelo | |
| 3,588,987 | A | 6/1971 | Korostoff et al. | |
| 3,647,137 | A | 3/1972 | Naydan | |
| 3,755,168 | A | 8/1973 | Mixon et al. | |
| 3,893,796 | A | 7/1975 | Korostoff et al. | |
| 3,907,069 | A | 9/1975 | Pryor et al. | |
| 3,907,484 | A | 9/1975 | Delforme et al. | |
| 3,921,915 | A | 11/1975 | Glenn et al. | |

(Continued)

FOREIGN PATENT DOCUMENTS

| | | |
|---|---|---|
| DE | 19726515 | 1/1998 |
| JP | 62-6211 | 1/1987 |
| JP | 03-119105 | 5/1991 |

OTHER PUBLICATIONS

Xie, Meiju, "Influence of Poly(ethylene glycol)-Containing Additives on Extrusion of Ultrahigh Molecular Weight Polyethylene/Polypropylene Blend," Jan. 30, 2006, Wiley Interscience, Journal of Applied Polymer Science, vol. 100, pp. 1282-1288.*

(Continued)

*Primary Examiner* — Peter Y Choi
(74) *Attorney, Agent, or Firm* — Douglas B. Little; James Baker; Adam Bramwell

(57) ABSTRACT

Polymeric fibers along with methods and systems for extruding polymeric fibers are disclosed. The extrusion process preferably involves the delivery of a lubricant separately from a polymer melt stream to each orifice of an extrusion die such that the lubricant preferably encases the polymer melt stream as it passes through the die orifice.

11 Claims, 4 Drawing Sheets

U.S. PATENT DOCUMENTS

| | | | | | |
|---|---|---|---|---|---|
| 3,925,525 | A | | 12/1975 | LaNieve | |
| 3,980,744 | A | | 9/1976 | Cogswell | |
| 3,988,410 | A | | 10/1976 | Larsen et al. | |
| 4,015,924 | A | | 4/1977 | LaNieve | |
| 4,118,326 | A | * | 10/1978 | Login | 427/172 |
| 4,179,529 | A | | 12/1979 | Vetter | |
| 4,202,948 | A | | 5/1980 | Peascoe | |
| 4,444,841 | A | | 4/1984 | Wheeler | |
| 4,560,734 | A | * | 12/1985 | Fujishita et al. | 526/142 |
| 4,599,214 | A | | 7/1986 | Luton | |
| 4,601,650 | A | | 7/1986 | Luton | |
| 4,607,792 | A | | 8/1986 | Young, III | |
| 4,721,637 | A | | 1/1988 | Suzuki et al. | |
| 4,909,975 | A | * | 3/1990 | Sawyer et al. | 264/210.7 |
| 4,927,585 | A | | 5/1990 | Suzuki et al. | |
| 5,068,073 | A | | 11/1991 | Pennings et al. | |
| 5,084,315 | A | | 1/1992 | Karimi et al. | |
| 5,246,657 | A | | 9/1993 | Yagi et al. | |
| 5,252,049 | A | | 10/1993 | Bøen | |
| 5,258,160 | A | | 11/1993 | Utsumi et al. | |
| 5,306,548 | A | | 4/1994 | Zabrocki et al. | |
| 5,307,843 | A | | 5/1994 | Jarrin et al. | |
| 5,340,509 | A | * | 8/1994 | Chang et al. | 264/5 |
| 5,357,784 | A | | 10/1994 | Collier | |
| 5,370,804 | A | | 12/1994 | Day | |
| 5,545,464 | A | * | 8/1996 | Stokes | 428/198 |
| 5,863,480 | A | | 1/1999 | Suwanda | |
| 5,882,690 | A | | 3/1999 | Fukuda et al. | |
| 5,942,452 | A | * | 8/1999 | Daponte et al. | 442/382 |
| 5,958,806 | A | * | 9/1999 | Jensen et al. | 442/401 |
| 6,010,592 | A | | 1/2000 | Jameson et al. | |
| 6,013,217 | A | | 1/2000 | Hauenstein et al. | |
| 6,153,136 | A | | 11/2000 | Collier et al. | |
| 6,200,669 | B1 | | 3/2001 | Marmon et al. | |
| 6,220,083 | B1 | | 4/2001 | Collier | |
| 6,264,781 | B1 | | 7/2001 | Bott | |
| 6,281,289 | B1 | * | 8/2001 | Maugans et al. | 525/191 |
| 6,284,189 | B1 | | 9/2001 | Pavlicevic et al. | |
| 6,350,399 | B1 | | 2/2002 | Cook et al. | |
| 6,359,077 | B1 | * | 3/2002 | Avgousti et al. | 525/333.8 |
| 6,417,122 | B1 | * | 7/2002 | Newkirk et al. | 442/364 |
| 6,531,559 | B1 | * | 3/2003 | Smith et al. | 526/255 |
| 6,766,817 | B2 | | 7/2004 | da Silva | |

OTHER PUBLICATIONS

ASTM D 1238-04, "Standard Test Method for Melt Flow Rates of Thermoplastic by Extrusion Plastomer", pp. 269-281.

ASTM D 3418-03, "Standard Test Method for Transition Temperatures of Polymers by Differential Scanning Calorimetry", pp. 331-337.

Binding et al., "On the Interpretation of data from Converging Flow Rheometers," *Rheologica Acta*, vol. 28, pp, 215-222 (1989).

Chatraei et al., "Lubricated Squeezing Flow: A New Biaxial Extensional Rheometer," *Journal of Rheology*, vol. 25(4); pp. 433-443 (1981).

Collier et al., "Elongational Rheology of Polymer Melts and Solutions," Journal of Applied Polymer Science, vol. 69, pp. 2357-2367 (1998).

Collier et al., "Lubricated Flow Polymer Melt Elongational Rheometry," *Theoretical and Applied Rheology*, P. Moldenaers and R. Keunings, Eds., Proc. XIth Int. Congr. On Rheology, Brussels, Belgium, pp. 904-906 (Aug. 17-21, 1992).

Crevecoeur et al., "Fibril Formation in In Situ Composites of a Thermotropic Liquid Crystalline Polymer in a Thermoplastic Matrix," *Journal of Applied Polymer Science*, vol. 49, pp. 839-849 (1993).

James, "Flow in a Converging Channel at Moderate Reynolds Numbers," *AiChE Journal*, vol. 37, No. 1, pp. 59-64 (Jan. 1991).

Jones et al., "On the extensional viscosity of mobile polymer solutions," *Rheologica Acta*, vol. 26, pp. 20-30 (1987).

Kim et al., "Polymer melt lubricated elongational flow," Journal of Rheology, vol. 38, No. 4, pp. 831-845 (Jul./Aug. 1994).

Macosko, "Chapter 7, Extensional Rheometry," *Rheology Principles, Measurements, and Applications*, Wiley-VCH, New York, Title page, Publication page, and pp. 285-336 (1994).

Meißner, "Dehnungsverhalten von Polyäthylen-Schmelzen," *Rheologica Acta*, vol. 10, pp. 230-242 (1971). (English Language Summary on p. 242).

Meißner, "Rheometer zur Untersichung der deformationsmechanischen Eigenschafter von Kunststoff-Schmelzen unter definierter Zugbeanspruchung," *Rheologica Acta*, vol. 8, No. 1, pp. 78-88 (1969). (English Language Summary on p. 88).

Pendse et al., "Elongational Viscosity of Polymer Melts," *ANTEC*, pp. 1129-1133 (1996).

Pendse et al., "Elongational Viscosity of Polymer Melts: A Lubricated Skin-Core Flow Approach," *Journal of Applied Polymer Science*, vol. 59, pp. 1305-1314 (1996).

Pendse et al., "Elongational Viscosity of Polypropylene Melts," *ANTEC*, pp. 1080-1084 (1995).

Pendse et al., "Polymer Melt Lubricated Flow Elongational Rheometry," *ANTEC*, pp. 1819-1823 (1994).

Romanoschi et al., "Polymer Melts and Concentrated Solutions Elongational Viscosity," *ANTEC*, pp. 972-976, (1998).

Williams et al., "On the Planar Extensional Viscosity of Mobile Liquids," *Journal of Non-Newtonian Fluid Mechanics*, vol. 19, pp. 53-80 (1985).

Winter et al.,"Orthogonal stagnation flow, a framework for steady extensional flow experiments," *Rheological Acta*, vol. 18, pp. 323-334 (1979).

Zahorski, "The converging flow rheometer reconsidered: an example of flow with dominating extension," *Journal of Non-Newtonian Fluid Mechanics*, vol. 41, pp. 309-322 (1992).

* cited by examiner

MELT EXTRUDED FIBERS AND METHODS OF MAKING THE SAME

RELATED APPLICATION

This application is a continuation-in-part of U.S. patent application Ser. No. 10/851,340, titled LUBRICATED FLOW FIBER EXTRUSION, and filed on May 21, 2004, now U.S. Pat. No. 7,476,352 which is hereby incorporated by reference in its entirety.

BACKGROUND OF THE INVENTION

The present invention relates to the field of polymer fibers, fiber extrusion processing and apparatus.

Conventional fiber forming methods and apparatus typically involves the extrusion of polymeric material through orifices. The rates, pressures and temperatures of the typical fiber extrusion process represent a compromise between economic requirements and the physical characteristics of the polymeric material. For example, the molecular weight of the polymeric material is directly tied to both melt viscosity and polymeric material performance. Unfortunately, improvements in polymeric material performance are conventionally tied to increased molecular weight and corresponding relatively high melt viscosities. The higher melt viscosities typically result in slower, less economically viable processes.

To address the high melt viscosities of higher molecular weight polymers, conventional processes may rely on relatively high temperature processing in an effort to lower the melt viscosity of the polymeric material. The process temperature may typically, however, be limited by degradation of the polymeric material at higher temperatures. In conjunction with increased process temperatures, the process pressures, i.e., the pressure at which the polymer is extruded, may also be increased to improve process speed. Process pressure may, however, be limited by the equipment employed to extrude the fibers. As a result, the processing speed in conventional processes is typically constrained by the factors discussed above.

In view of the issues discussed above, the conventional strategy in extruding molten polymer for fiber making is to reduce the molecular weight of the polymeric material to attain economically viable processing rates. The reduced molecular weight results in a corresponding compromise in material properties of the extruded polymeric fibers.

To at least partially address the compromises in material properties of conventional extruded fibers, the fiber strength may be improved by orienting the polymeric material in the fiber. Orientation is imparted by pulling or stretching the fiber after it exits the extrusion die. As a result, the polymeric material used for the fibers typically must have a substantial tensile stress carrying capability in the semi-molten state in which the polymeric material exits the die (or the fibers will merely break when pulled). Such properties are conventionally available in semi-crystalline polymers such as, e.g., polyethylene, polypropylene, polyesters, and polyamides. Thus, conventional fiber extrusion processes can be performed with only a limited number of polymeric materials.

SUMMARY OF THE INVENTION

The present invention provides methods and systems for extruding polymeric fibers and the polymeric fibers produced by those methods. The extrusion process preferably involves the delivery of a lubricant separately from a polymer melt stream to each orifice of an extrusion die such that the lubricant preferably encases the polymer melt stream as it passes through the die orifice. The use of a lubricant delivered separately from the polymer melt stream in a polymeric fiber extrusion process can provide a number of potential advantages.

For example, the use of separately-delivered lubricant can provide for oriented polymeric fibers in the absence of pulling, i.e., in some embodiments it may not be necessary to pull or stretch the fiber after it exits the die to obtain an oriented polymeric fiber. If the polymeric fibers are not pulled after extrusion, they need not exhibit substantial tensile stress-carrying capability in the semi-molten state that they are in after exiting the die. Instead, the lubricated extrusion methods of the present invention can, in some instances, impart orientation to the polymeric material as it moves through the die such that the polymeric material may preferably be oriented before it exits the die.

One potential advantage of reducing or eliminating the need for pulling or stretching to impart orientation is that the candidate polymeric materials for extruding polymeric fibers can be significantly broadened to include polymeric materials that might not otherwise be used for extruded fibers. Heterophase polymers may also be extruded into an oriented fiber via the proposed method. Composite fiber constructions such as 'sheath/core' or 'islands-in-the-sea' or 'pie' or 'hollow pie' are also compatible with this method.

Potential advantages of the methods of the present invention may include, e.g., the ability to extrude multiple polymeric fibers simultaneously at relatively low pressures. The relatively low pressures may result in cost savings in terms of equipment and process costs.

Another potential advantage of polymeric fibers manufactured by the methods of the present invention may be found in the surface roughness of the extruded fibers. For example, polymeric fibers of the present invention may exhibit a surface roughness that is significantly less than fibers manufactured of similar polymers by conventional fiber manufacturing processes such as gel spinning, etc.

For the purposes of the present invention, the term "fiber" (and variations thereof) means a slender, threadlike structure or filament that has a substantially continuous length relative to its width, e.g., a length that is at least 1000 times its width. The width of the fibers of the present invention may preferably be limited to a maximum dimension of 5 millimeters or less, preferably 2 millimeters or less, and even more preferably 1 millimeter or less.

The fibers of the present invention may be monocomponent fibers; bicomponent or conjugate fibers (for convenience, the term "bicomponent" will often be used to mean fibers that consist of two components as well as fibers that consist of more than two components); and fiber sections of bicomponent fibers, i.e., sections occupying part of the cross-section of and extending over the length of the bicomponent fibers.

Another potential advantage of some embodiments of the present invention may be found in the ability to extrude polymers with a low Melt Flow Index (MFI). In conventional polymeric fiber extrusion processes, the MFI of the extruded polymers is about 35 or higher. Using the methods of the present invention, the extrusion of polymeric fibers can be achieved using polymers with a MFI of 30 or less, in some instances 10 or less, in other instances 1 or less, and in still other instances 0.1 or less. Before the present invention, extrusion processing of such high molecular weight (low MFI) polymers to form fibers was typically performed with the use of solvents to dissolve the polymer thereby reducing its viscosity. This method carries with it the difficulty of dissolving the high molecular polymer and then removing it (including disposal or recycling). Examples of low melt flow index polymers include LURAN S 757 (ASA, 8.0 MFI) available from BASF Corporation of Wyandotte, Mich., P4G2Z-026 (PP, 1.0 MFI) available from Huntsman Polymers of Houston, Tex., FR PE 152 (HDPE, 0.1 MFI) available from PolyOne Corporation of Avon Lake, Ohio, 7960.13 (HDPE, 0.06 MFI) available from ExxonMobil Chemical of Houston, Tex. ENGAGE 8100 (ULDPE, 1.0 MFI) available from ExxonMobil Chemical of Houston, Tex.

Another potential advantage of some methods of the present invention may include the relatively high mass flow rates that may be achieved. For example, using the methods of the present invention, it may be possible to extrude polymeric material into fibers at rates of 10 grams per minute or higher, in some instances 100 grams per minute or higher, and in other instances at rates of 400 grams per minute or higher. These mass flow rates may be achieved through an orifice having an area of 0.2 square millimeters ($mm^2$) or less.

Still another potential advantage of some methods of the present invention may include the ability to extrude polymeric fibers that include orientation at the molecular level that may, e.g., enhance the strength or provide other advantageous mechanical, optical, etc. properties. If the polymeric fibers are constructed of amorphous polymers, the amorphous polymeric fibers may optionally be characterized as including portions of rigid or ordered amorphous polymer phases or oriented amorphous polymer phases (i.e., portions in which molecular chains within the fiber are aligned, to varying degrees, generally along the fiber axis).

Although oriented polymeric fibers are known, the orientation is conventionally achieved by pulling or drawing the fibers as they exit a die orifice. Many polymers cannot, however, be pulled after extrusion because they do not possess sufficient mechanical strength immediately after extrusion in the molten or semi-molten state to be pulled without breaking. The methods of the present invention can, however, eliminate the need to draw polymeric fibers to achieve orientation because the polymeric material may be oriented within the die before it exits the orifice. As a result, oriented fibers may be extruded using polymers that could not conventionally be extruded and drawn in a commercially viable process.

In some methods of the present invention, it may be preferably to control the temperature of the lubricant, the die, or both the lubricant and the die to quench the polymeric material such that the orientation is not lost or is not significantly reduced due to relaxation outside of the die. In some instances, the lubricant may be selected based, at least in part, on its ability to quench the polymeric material by, e.g., evaporation.

In one aspect, the present invention provides an extruded polymeric fiber including one or more polymers, wherein all of the one or more polymers have a melt flow index of 30 or less measured at the conditions specified for the one or more polymers, and wherein the fiber has a continuous length that is at least 1000 times its width, and further wherein the fiber has an average roughness (Ra) of about 1000 nanometers or less.

In another aspect, the present invention provides an extruded polymeric fiber including one or more polymers, wherein all of the one or more polymers have a melt flow index of 30 or less measured at the conditions specified for the one or more polymers, and wherein the polymeric fiber is extruded by passing a polymer melt stream through an orifice located within a die, wherein the orifice has an entrance, an exit and an interior surface extending from the entrance to the exit, wherein the orifice is a semi-hyperbolic converging orifice, and wherein the polymer melt stream enters the orifice at the entrance and leaves the orifice at the exit; delivering lubricant to the orifice separately from the polymer melt stream, wherein the lubricant is introduced at the entrance of the orifice; and collecting the polymeric fiber formed by the polymer melt stream after the polymer melt stream leaves the exit of the orifice.

In another aspect, the present invention provides an extruded polymeric fiber with a continuous length that is at least 1000 times its width, wherein the fiber consists essentially of a multiphase polymer with an arrangement of macromolecules that exhibit distinctly different domains in the fiber.

In another aspect, the present invention provides a method of making a polymeric fiber by passing a polymer melt stream through an orifice located within a die, wherein the orifice has an entrance, an exit and an interior surface extending from the entrance to the exit, wherein the orifice is a semi-hyperbolic converging orifice, and wherein the polymer melt stream enters the orifice at the entrance and leaves the orifice at the exit; delivering lubricant to the orifice separately from the polymer melt stream, wherein the lubricant is introduced at the entrance of the orifice; and collecting a fiber including the polymer melt stream after the polymer melt stream leaves the exit of the orifice.

In another aspect, the present invention provides a method of making a polymeric fiber by passing a polymer melt stream through an orifice of a die, wherein the orifice has an entrance, an exit and an interior surface extending from the entrance to the exit, wherein the orifice is a semi-hyperbolic converging orifice, wherein the polymer melt stream enters the orifice at the entrance and leaves the orifice at the exit, wherein the polymer melt stream includes a bulk polymer, wherein the bulk polymer is a majority of the polymer melt stream, and wherein the bulk polymer consists essentially of a polymer with a melt flow index of 1 or less measured at the conditions specified for the polymer in ASTM D1238; delivering lubricant to the orifice separately from the polymer melt stream; and collecting a fiber including the bulk polymer after the polymer melt stream leaves the exit of the orifice.

These and other features and advantages of various embodiments of the methods, systems, and articles of the present invention may be described below in connection with various illustrative embodiments of the present invention.

DETAILED DESCRIPTION OF ILLUSTRATIVE EMBODIMENTS OF THE INVENTION

Figure 1:
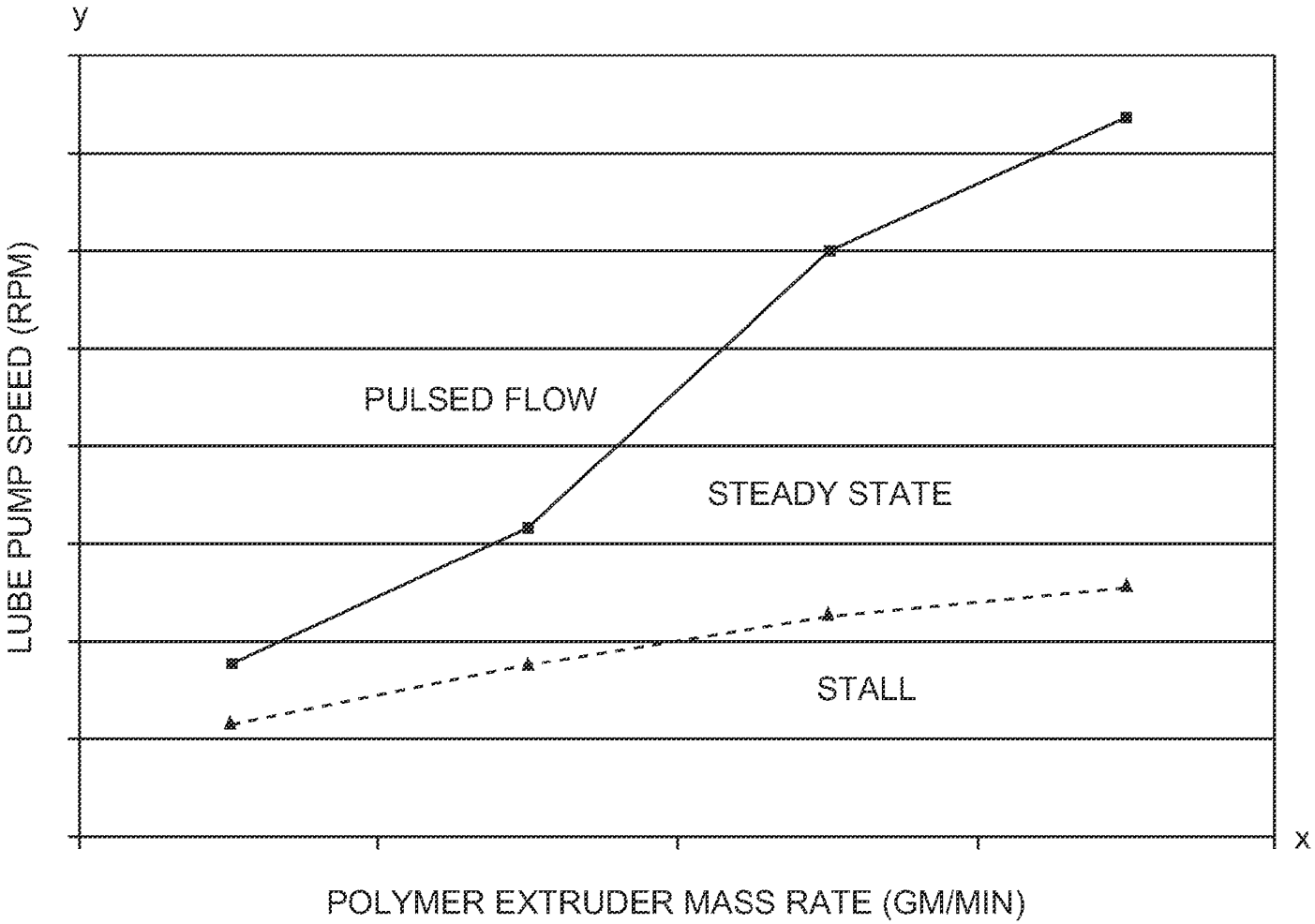
FIG. 1 is a schematic diagram illustrating a process window for methods according to the present invention.

In the following detailed description of illustrative embodiments of the invention, reference is made to the accompanying figures of the drawing which form a part hereof, and in which are shown, by way of illustration, specific embodiments in which the invention may be practiced. It is to be understood that other embodiments may be utilized and structural changes may be made without departing from the scope of the present invention.

As discussed above, the present invention provides methods and systems for manufacturing polymeric fibers through a lubricated flow extrusion process. The present invention may also include polymeric fibers that may be manufactured using such systems and methods.

The methods of the present invention preferably involve the extrusion of a polymer melt stream from a die having one or more orifices. A lubricant is delivered to the die separately from the polymer melt stream, preferably in a manner that results in the lubricant being preferentially located about the outer surface of the polymer melt stream as it passes through the die. The lubricant may be another polymer or another material such as, e.g., mineral oil, etc. It may be preferred that the viscosity of the lubricant be substantially less than the viscosity of the lubricated polymer (under the conditions at which the lubricated polymer is extruded). Some exemplary dies and fibers that may be extruded from them are described below.

One potential advantage of using a lubricant in the methods and systems of the present invention is that the process window at which fibers may be manufactured may be widened relative to conventional polymer fiber extrusion processes. FIG. 1 depicts a dimensionless graph to illustrate this potential advantage. The flow rate of the polymer melt stream increases moving to the right along the x-axis and the flow rate of the lubricant increases moving upward along the y-axis. The area between the broken line (depicted nearest the x-axis) and the solid line (located above the broken line) is indicative of area in which the flow rates of the polymer melt stream and the lubricant can be maintained at a steady state with respect to each other. Characteristics of steady state flow are preferably steady pressures for both the polymer melt stream and the lubricant. In addition, steady state flow may also preferably occur at relatively low pressures for the lubricant and/or the polymer melt stream.

The area above the solid line (on the opposite side of the solid line from the broken line) is indicative of the region in which an excess of lubricant may cause flow of the polymer melt stream through the die to pulse. In some instances, the pulsation can be strong enough to interrupt the polymer melt stream flow and break or terminate any fibers exiting the die.

The area below the broken line (i.e., between the broken line and the x-axis) is indicative of the conditions at which the lubricant flow stalls or moves to zero. In such a situation, the flow of the polymer melt stream is no longer lubricated and the pressure of the polymer melt stream and the lubricant typically rise rapidly. For example, the pressure of the polymer melt stream can rise from 200 psi ($1.3\times10^6$ Pa) to 2400 psi ($1.4\times10^7$ Pa) in a matter of seconds under such conditions. This area would be considered the conventional operating window for traditional non-lubricated fiber forming dies, with the mass flow rate of the polymers being limited principally by the high operating pressures.

The widened process window illustrated in FIG. 1 may preferably be provided using a die in which the orifices converge in a manner that results in essentially pure elongational flow of the polymer. To do so, it may be preferred that the die orifice have a semi-hyperbolic converging profile along its length (i.e., the direction in which the first polymer flows) as discussed herein.

Among the potential advantages of at least some embodiments of the present invention is the ability to manufacture polymeric fibers of polymeric materials that are not typically extruded into polymeric fibers. Melt flow index is a common industry term related to the melt viscosity of a polymer. American Society for Testing and Materials (ASTM) includes a test method (ASTM D1238). This test method specifies loads and temperatures that are to be used to measure specific polymer types. As used herein, melt flow index values are to be obtained at the conditions specified by ASTM D1238 for the given polymer type. In accordance with ASTM D1238, all melt flow index values used herein have units of g/10 min. The general principle of melt index testing involves heating the polymer to be tested in a cylinder with a plunger on top and a small capillary or orifice located at the bottom of the cylinder. When thermally equilibrated, a predetermined weight is placed on the plunger and extrudate is collected and weighed for a predetermined amount of time. A higher melt index value is typically associated with a higher flow rate and lower viscosity, both of which may be indicative of a lower molecular weight. Conversely, low melt index values are typically associated with lower flow rates and higher viscosities, both of which may be indicative of a higher molecular weight polymer.

In conventional polymeric fiber extrusion processes, the MFI of the extruded polymers is about 35 or higher. Using the methods of the present invention, the polymer melt stream used to form the extruded polymeric fibers may include one or more polymers, with all of the one or more polymers exhibiting a MFI of 30 or less, in some instances 10 or less, in other instances 1 or less, and in still other instances 0.1 or less. In some embodiments, the polymer melt stream may consist essentially of one polymer that preferably exhibits a MFI of 30 or less, in some instances 10 or less, in other instances 1 or less, and in still other instances 0.1 or less.

Another manner in which the polymeric fibers extruded according to the methods of the present invention may be characterized is in terms of surface roughness. It may be preferred, for example, that melt-extruded polymeric fibers (having a length that is at least 1000 times greater than their width) exhibit an average roughness (Ra) over the length of the fiber of 1000 nanometers (nm) or less, potentially 500 nm or less, or even 400 nm or less. In another manner of characterizing the fibers that may be used alone or in conjunction with average roughness (Ra), the melt-extruded polymeric fibers may preferably exhibit a root-mean-square roughness (Rq) over the length of the fiber of 1000 nm or less, or even 500 nm or less.

In some embodiments, the polymer melt stream may be characterized as including a bulk polymer that forms at least a majority of the volume of the polymer melt stream. In some instances, it may be preferred that the bulk polymer form 60% or more of the volume of the polymer melt stream, or in other instances, it may be preferred that the bulk polymer form 75% or more of the volume of the polymer melt stream. In these instances, the volumes are determined as the polymer melt stream is delivered to the orifice of a die.

The bulk polymer may preferably exhibit a MFI of 30 or less, in some instances 10 or less, in other instances 1 or less, and in still other instances 0.1 or less. In embodiments that can be characterized as including a bulk polymer, the polymer melt stream may include one or more secondary polymers in addition to the bulk polymer. In various embodiments, the secondary polymers may preferably exhibit a MFI of 30 or less, in some instances 10 or less, in other instances 1 or less, and in still other instances 0.1 or less.

Some examples of polymers that may be low MFI polymers and that may be extruded into fibers in connection with the present invention may include, e.g., Ultra High Molecular Weight polyethylene (UHMWPE), Ethylene-Propylene-Diene-Monomer (EPDM) rubber, high molecular weight polypropylene, polycarbonate, ABS, AES, polyimids, norbornenes, Z/N and Metallocene copolymers (EAA, EMAA, EMMA, etc), polyphenylene sulfide, ionomers, polyesters, polyamides, and derivatives (e.g., PPS, PPO PPE).

Other examples of low MFI polymers that may be compatible with the present invention are the traditional "glassy" polymers. The term "glassy" used here is the same traditional use of a dense random morphology that displays a glass transition temperature ($T_g$), characteristic of density, rheology, optical, and dielectric changes in the material. Examples of glassy polymers may include, but are not limited to, polymethylmethacrylates, polystyrenes, polycarbonates, polyvinylchlorides, etc.

Still other examples of low MFI polymers that may be compatible with the present invention are the traditional "rubbery" polymers. The term "rubbery" is the same as used in traditional nomenclature: a random macromolecular material with sufficient molecular weight to form significant entanglement as to result in a material with a long relaxation time. Examples of "rubbery" polymers may include, but are not limited to; polyurethanes, ultra low density polyethylenes, styrenic block copolymers such as styrene-isoprene-styrene (SIS), styrene-butadiene-styrene (SBS) styrene-ethylene/butylene-styrene (SEBS), polyisoprenes, polybutadienes, EPDM rubber, and their analogues.

The present invention may also be used to extrude amorphous polymers into fibers. As used herein, an "amorphous polymer" is a polymer having little to no crystallinity usually indicated by the lack of a distinctive melting point or first order transition when heated in a differential scanning calorimeter according to ASTM D3418.

In still other embodiments, a potential advantage of the present invention may be found in the ability to extrude polymeric fibers using a multiphase polymer as the polymer melt stream and a lubricant. By multiphase polymer, we may mean, e.g., organic macromolecules that are composed of different species that coalesce into their own separate regions. Each of the regions has its own distinct properties such as glass transition temperature (Tg), gravimetric density, optical density, etc. One such property of a multiphase polymer is one in which the separate polymeric phases exhibit different rheological responses to temperature. More specifically, their melt viscosities at extrusion process temperatures can be distinctly different. Examples of some multiphase polymers may be disclosed in, e.g., U.S. Pat. No. 4,444,841 (Wheeler), U.S. Pat. No. 4,202,948 (Peascoe), and U.S. Pat. No. 5,306,548 (Zabrocki et al.).

As used herein, "multiphase" refers to an arrangement of macromolecules including copolymers of immiscible monomers. Due to the incompatibility of the copolymers present, distinctly different phases or "domains" may be present in the same mass of material. Examples of thermoplastic polymers that may be suitable for use in extruding multiphase polymer fibers according to the present invention include, but are not limited to materials from the following classes: multiphase polymers of polyethers, polyesters, or polyamides; oriented syndiotactic polystyrene, polymers of ethylene-propylene-diene monomers ("EPDM"), including ethylene-propylene-nonconjugated diene ternary copolymers grafted with a mixture of styrene and acrylonitrile (also known as acrylonitrile EPDM styrene or "AES"); styrene-acrylonitrile ("SAN") copolymers including graft rubber compositions such as those comprising a crosslinked acrylate rubber substrate (e.g., butyl acrylate) grafted with styrene and acrylonitrile or derivatives thereof (e.g., alpha-methyl styrene and methacrylonitrile) known as "ASA" or acrylate-styrene-acrylonitrile copolymers, and those comprising a substrate of butadiene or copolymers of butadiene and styrene or acrylonitrile grafted with styrene or acrylonitrile or derivatives thereof (e.g., alpha-methyl styrene and methacrylonitrile) known as "ABS" or acrylonitrile-butadiene-styrene copolymers, as well as extractable styrene-acrylonitrile copolymers (i.e., nongraft copolymers) also typically referred to as "ABS" polymers; and combinations or blends thereof. As used herein, the term "copolymer" should be understood as including terpolymers, tetrapolymers, etc.

Some examples of polymers that may be used in extruding multiphase polymer fibers may be found within the styrenic family of multiphase copolymer resins (i.e., a multiphase styrenic thermoplastic copolymer) referred to above as AES, ASA, and ABS, and combinations or blends thereof. Such polymers are disclosed in U.S. Pat. No. 4,444,841 (Wheeler), U.S. Pat. No. 4,202,948 (Peascoe), and U.S. Pat. No. 5,306,548 (Zabrocki et al.). The blends may be in the form of multilayered fibers where each layer is a different resin, or physical blends of the polymers which are then extruded into a single fiber. For example, ASA and/or AES resins can be coextruded over ABS.

Multiphase polymer systems can present major challenges in fiber processing because the different phases can have very different theological responses to processing. For example, the result may be poor tensile response of multiphase polymers. The different theological response of the different phases may cause wide variations in the drawing responses during conventional fiber forming processes that involve drawing or pulling of the extruded fibers. In many instances, the presence of multiple polymer phases exhibits insufficient cohesion to resist the tensile stresses of the drawing process, causing the fibers to break or rupture.

In the present invention, the unique challenges that may be associated with extruding multiphase polymers may be addressed based on how the material is oriented during fiber formation. It may be preferred that, in connection with the present invention, the multiphase polymer material is squeezed or 'pushed' through the die orifice to orient the polymer materials (as opposed to pulling or drawing). As a result, the present invention may substantially reduce the potential for fracture.

Some multiphase polymers that may be used in the methods according to the present invention are the multiphase AES and ASA resins, and combinations or blends thereof. Commercially available AES and ASA resins, or combinations thereof, include, for example, those available under the trade designations ROVEL from Dow Chemical Company, Midland, Mich., and LORAN S 757 and 797 from BASF Aktiengesellschaft, Ludwigshafen, Fed. Rep. of Germany), CENTREX 833 and 401 from Bayer Plastics, Springfield, Conn., GELOY from General Electric Company, Selkirk, N.Y., VITAX from Hitachi Chemical Company, Tokyo, Japan. It is believed that some commercially available AES and/or ASA materials also have ABS blended therein. Commercially available SAN resins include those available under the trade designation TYRIL from Dow Chemical, Midland, Mich. Commercially available ABS resins include those available under the trade designation CYOLAC such as CYOLAC GPX 3800 from General Electric, Pittsfield, Mass.

The multiphase polymer fibers can also be prepared from a blend of one or more of the above-listed materials and one or more other thermoplastic polymers. Examples of such thermoplastic polymers that can be blended with the above-listed yielding materials include, but are not limited to, materials from the following classes: biaxially oriented polyethers; biaxially oriented polyesters; biaxially oriented polyamides; acrylic polymers such as poly(methyl methacrylate); polycarbonates; polyimides; cellulosics such as cellulose acetate, cellulose (acetate-co-butyrate), cellulose nitrate; polyesters such as poly(butylene terephthalate), poly(ethylene terephthalate); fluoropolymers such as poly(chlorofluoroethylene), poly(vinylidene fluoride); polyamides such as poly(caprolactam), poly(amino caproic acid), poly(hexamethylene diamine-co-adipic acid), poly(amide-co-imide), and poly(ester-co-imide); polyetherketones; poly(etherimide); polyolefins such as poly(methylpentene); aliphatic and aromatic polyurethanes; poly(phenylene ether); poly(phenylene sulfide); atactic poly(styrene); cast syndiotactic polystyrene; polysulfone; silicone modified polymers (i.e., polymers that contain a small weight percent (less than 10 weight percent) of silicone) such as silicone polyamide and silicone polycarbonate; ionomeric ethylene copolymers such as poly(ethylene-co-methacrylic acid) with sodium or zinc ions, which are available under the trade designations SURLYN-8920 and SURLYN-9910 from E.I. duPont de Nemours, Wilmington, Del.; acid functional polyethylene copolymers such as poly (ethylene-co-acrylic acid) and poly(ethylene-co-methacrylic acid), poly(ethylene-co-maleic acid), and poly(ethylene-co-fumaric acid); fluorine modified polymers such as perfluoropoly(ethyleneterephthalate); and mixtures of the above polymers such as a polyimide and acrylic polymer blend, and a poly(methylmethacrylate) and fluoropolymer blend.

The polymer compositions used in connection with the present invention may include other ingredients, e.g., UV stabilizers and antioxidants such as those available from Ciba-Geigy Corp., Ardsley, N.Y., under the trade designation IRGANOX. pigments, fire retardants, antistatic agents, mold release agents such as fatty acid esters available under the trade designations LOXIL G-715 or LOXIL G-40 from Henkel Corp., Hoboken, N.J., or WAX E from Hoechst Celanese Corp., Charlotte, N.C. Colorants, such as pigments and dyes, can also be incorporated into the polymer compositions. Examples of colorants may include rutile $TiO_2$ pigment available under the trade designation R960 from DuPont de Nemours, Wilmington, Del., iron oxide pigments, carbon black, cadmium sulfide, and copper phthalocyanine. Often, the above-identified polymers are commercially available with one or more of these additives, particularly pigments and stabilizers. Typically, such additives are used in amounts to impart desired characteristics. Preferably, they are used in amounts of about 0.02-20 wt-%, and more preferably about 0.2-10 wt-%, based on the total weight of the polymer composition.

Another potential advantage of at least some embodiments of the present invention is the ability to extrude the polymer melt stream at a relatively low temperature. For example, in the case of semi-crystalline polymers, it may be possible to extrude the polymer melt stream when the average temperature of the polymer melt stream as pushed through the entrance of each orifice in the die is within 10 degrees Celsius or less above a melt processing temperature of the polymer melt stream. In some embodiments, the average temperature of the polymer melt stream may preferably be at or below a melt processing temperature of the polymer melt stream before the polymer melt stream leaves the exit of the orifice. To do so, it may be preferred that the die temperature be controlled to a temperature that is at or below the melt processing temperature of the polymer melt stream.

Although not wishing to be bound by theory, it is theorized that the present invention may rely on the dominance of the lubricant properties to process the polymer during extrusion, with the polymer viscosity playing a relatively minor factor in stress (pressure and temperature) response. Further, the presence of the lubricant may allow "quenching" (e.g., crystal or glass "vitrification" formation) of the polymer within the die. A potential advantage of in-die quenching may include, e.g., retaining orientation and dimensional precision of the extrudate.

As used herein, the "melt processing temperature" of the polymer melt stream is the lowest temperature at which the polymer melt stream is capable of passing through the orifices of the die within a period of 1 second or less. In some instances, the melt processing temperature may be at or slightly above the glass transition temperature if the polymer melt stream is amorphous or at or slightly above the melting temperature if the polymer melt stream is crystalline or semicrystalline. If the polymer melt stream includes one or more amorphous polymers blended with either or both of one or more crystalline and one or more semicrystalline polymers, then the melt processing temperature is the lower of the lowest glass transition temperature of the amorphous polymers or the lowest melting temperature of the crystalline and semicrystalline polymers.

Figure 2:
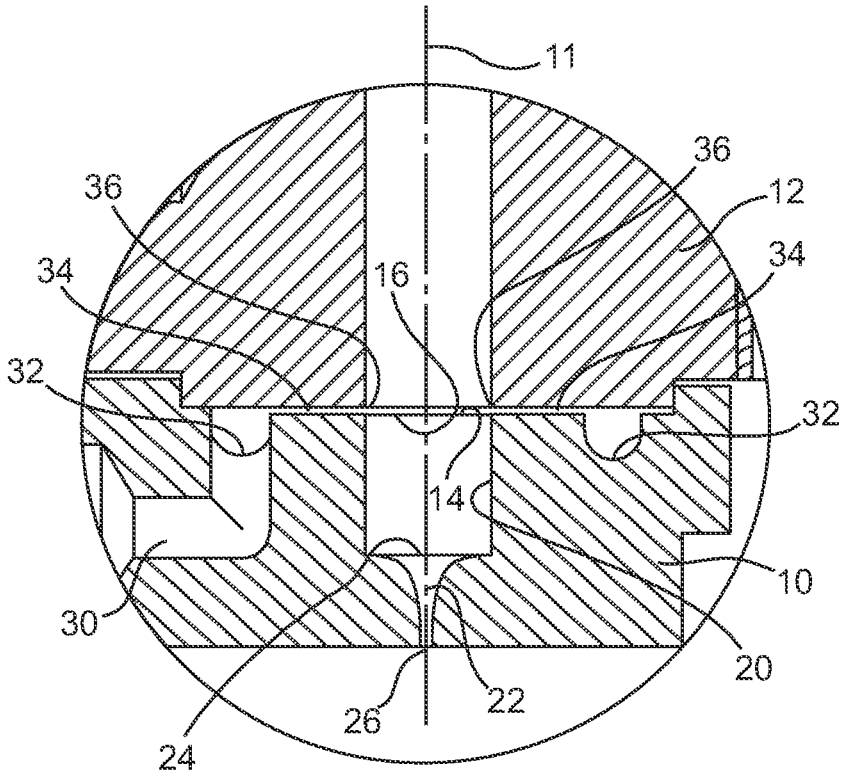
FIG. 2 is an enlarged cross-sectional view of a portion of one exemplary die that may be used in connection with the present invention.

One exemplary die orifice that may be used in dies according to the present invention is depicted in the cross-sectional view of FIG. 2 in which a die plate 10 and a complementary die plate cover 12 are depicted in a cross-sectional view. The die plate 10 and die plate cover 12 define a polymer delivery passage 20 that is in fluid communication with an orifice 22 in the die plate 10. The portion of the polymer delivery passage 20 formed in the die plate cover 12 terminates at opening 16, where the polymer melt stream enters the portion of polymer delivery passage 20 formed within the die plate 10 through opening 14. In the depicted embodiment, the opening 16 in the die plate cover 12 is generally the same size as the opening 14 in the die plate 10.

Figure 3:
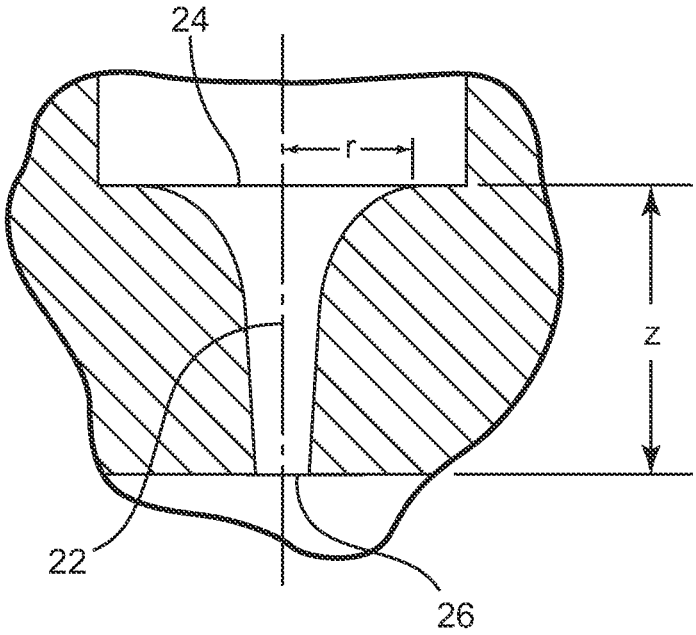
FIG. 3 is an enlarged view of the orifice in the die of FIG. 2.

FIG. 3 depicts an enlarged view of the orifice 22 with the addition of reference letter "r" indicative of the radius of the orifice 22 and "z" indicative of the length of the orifice 22 along the axis 11. The orifice 22 formed in the die plate 10 may preferably converge such that the cross-sectional area (measured transverse to the axis 11) is smaller than the cross-sectional area of the entrance 24. It may be preferred that, as discussed herein, the shape of the die orifice 22 be designed such that the elongational strain rate of the polymer melt stream be constant along the length of the orifice 22 (i.e., along axis 11).

As discussed herein, it may be preferred that the die orifice have a converging semi-hyperbolic profile. The definition of a "semi-hyperbolic" shape begins with the fundamental relationship between volume flow, area of channel and fluid velocity. Although cylindrical coordinates are used in connection with the description of orifice 22, it should be understood that die orifices used in connection with the present invention may not have a circular cylindrical profile.

Flow through the orifice 22 along axis 11 can be described at each position along the axis 11 by the following equation:

$$Q=V*A \quad (1)$$

where Q is the measure of volumetric flow through the orifice, V is the flow velocity through the orifice, and A is the cross-sectional area of the orifice 22 at the selected location along the axis 11.

Equation (1) can be rearranged and solved for velocity to yield the following equation:

$$V=Q/A \tag{2}$$

Because the cross-sectional area of a converging orifice changes along the length of the channel of the orifice, the following equation can be used to describe the various relationships between variables in Equation (2):

$$dV_z/dz=(-Q/A^2)(dA/dz) \tag{3}$$

In Equation (3), the expression for the change in velocity with the change in position down the length of the orifice also defines extensional flow (∈) of the fluid. Steady or constant extensional flow may be a preferred result of flow through a converging orifice. As a result, it may be preferred that the cross-sectional area of the orifice change in such a way as to result in constant extensional flow through the orifice. An equation that defines steady or constant extensional flow may be expressed as:

$$dV_z/dz=\in=\text{constant} \tag{4}$$

An expression that can be substituted for the change in area with the change in position down the length of the orifice and that will yield a constant or steady extensional flow may be expressed as $$f(r;z)=\text{Constant}=r^2z \tag{5}$$

A generic form of the expression of Equation (5) may be the following:

$$f(r;z)=C_1+C_2r^2z \tag{6}$$

Equation (6) may be used to determine the shape of an orifice 22 as used in connection with the present invention. To design the shape of an orifice, it may be preferred that the geometric constraint of the diameter of the exit 26 of the orifice 22 be determined (with the understanding that exit diameter is indicative of the fiber size extruded from the orifice 22). Alternatively, the diameter of the entrance 24 of the orifice 22 may be used.

When the radius (and, thus, the corresponding area) of one of entrance 24 or the exit 26 of the orifice 22 is chosen, then the other may be determined by selecting the desired extensional strain selected, then the other radius (i.e., the radius of the entrance 24 or the exit 26) may preferably be determined by selecting the desired extensional strain to experienced by the fluid (i.e., polymer melt stream) passing through the orifice 22.

This value, i.e., the extensional strain, may sometimes be referred to as the "Hencky Strain." Hencky Strain is based on extensional or engineering strain of a material being stretched. The equation presented below describes Hencky Strain for a fluid in passing through a channel, e.g., an orifice in the present invention:

$$\text{Hencky Strain on Fluid}=\ln(r_o^2/r_z^2)=\ln(A_o/A_z). \tag{7}$$

Selection of the desired Hencky Strain to be experienced by the fluid passing through the orifice fixes or sets the radius (and, thus, the area) the other end of the orifice as discussed above. The last remaining design feature is to establish the length of the orifice to be lubricated. Once the length of the orifice 22 ("z" in FIG. 3) is selected and the radii/areas of the entrance 24 and exit are known, Equation 6 can be regressed for radius (area) change with the change in position down the length of the orifice 22 (along the "z" direction) to obtain the constants $C_1$ and $C_2$. The following equation provides the radius of the orifice at each location along the "z" dimension ($r_z$):

$$r_z=[((z)(e^s-1)+\text{Length})/(r_{entrance}{}^2*\text{Length})]^{-1/2} \tag{8}$$

where z is the location along the longitudinal axis in the z direction as measured from the entrance of the orifice; $e=(r_{entrance})^2/(r_{exit})^2$; s=Hencky Strain; $r_{entrance}$ is the radius at the entrance to the orifice; $r_{exit}$ is the radius at the exit of the orifice; and Length is the overall length of the orifice in the z direction from the entrance to the exit of the orifice. For a discussion of Hencky Strain and associated principles, reference may be had to C. W. Macosko "Rheology—Principles, Measurements and Applications," pp. 285-336 (Wiley-VCH Inc., New York, 1st Ed. 1994).

Returning to FIG. 2, the die plate 10 also includes a lubricant passage 30 in fluid communication with a lubricant plenum 32 formed between the die plate 10 and the die plate cover 12. The die plate 10 and the die plate cover 12 preferably define a gap 34 such that a lubricant passed into the lubricant plenum 32 through the lubricant passage 30 will pass into the polymer delivery passage 20 from slot 36 and through opening 14. As such, the lubricant can be delivered to the orifice 22 separately from the polymer melt stream.

The slot 36 may preferably extend about the perimeter of the polymer delivery passage 20. The slot 36 may preferably be continuous or discontinuous about the perimeter of the polymer delivery passage 20. The spacing between the die plate 10 and the die plate cover 12 that forms gap 34 and slot 36 may be adjusted based on a variety of factors such as the pressure at which a polymer melt stream is passed through the polymer delivery passage 20, the relative viscosities of the polymer melt stream and the lubricant, etc. In some instances, the slot 36 may be in the form of an opening or openings formed by the interface of two roughened (e.g., sandblasted, abraded, etc.) surfaces forming gap 34 (or one roughened surface and an opposing smooth surface).

Figure 4:
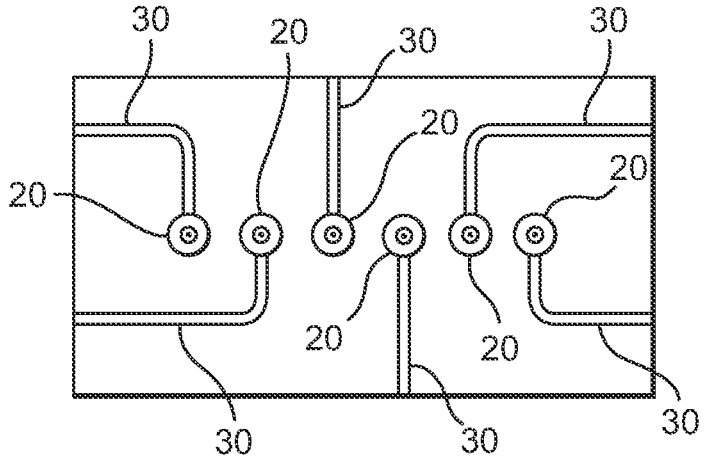
FIG. 4 is a plan view of a portion of one exemplary extrusion die plate that may be used in connection with the present invention.

FIG. 4 is a plan view of the die plate 10 with the die plate cover 12 removed. Multiple openings 14, polymer delivery passages 20, die orifices 22, and lubricant plenums 32 are depicted therein. The depicted polymer delivery passages 20 have a constant cross-sectional area (measured transverse to the axis 11 in FIG. 2) and are, in the depicted embodiment, circular cylinders. It should be understood, however, that the polymer delivery passages 20 and associated die orifices 22 may have any suitable cross-sectional shape, e.g., rectangular, oval, elliptical, triangular, square, etc.

It may be preferred that the lubricant plenums 32 extend about the perimeters of the polymer delivery passages 20 as seen in FIG. 4 such that the lubricant can be delivered about the perimeter of the polymer delivery passages 20. By doing so, the lubricant preferably forms a layer about the perimeter of a polymer melt stream as it passes through the polymer delivery passages 20 and into the die orifices 22. In the depicted embodiment, the plenums 32 are supplied by lubricant passages 30 that extend to the outer edges of the die plate 10 as seen in FIG. 4.

It may be preferred that each of the plenums 32 be supplied by an independent lubricant passage 30 as seen in FIG. 4. By supplying each of the plenums 32 (and their associated die orifices 22) independently, control over a variety of process variable can be obtained. Those variables may include, for example, the lubricant pressure, the lubricant flow rate, the lubricant temperature, the lubricant composition (i.e., different lubricants may be supplied to different orifices 22), etc.

As an alternative, however, it may be preferred in some systems that a master plenum be used to supply lubricant to each of the lubricant passages 30 which, in turn, supply lubricant to each of the plenums 32 associated with the orifices 22. In such a system, the delivery of lubricant to each orifice may preferably be balanced between all of the orifices.

Figure 5:
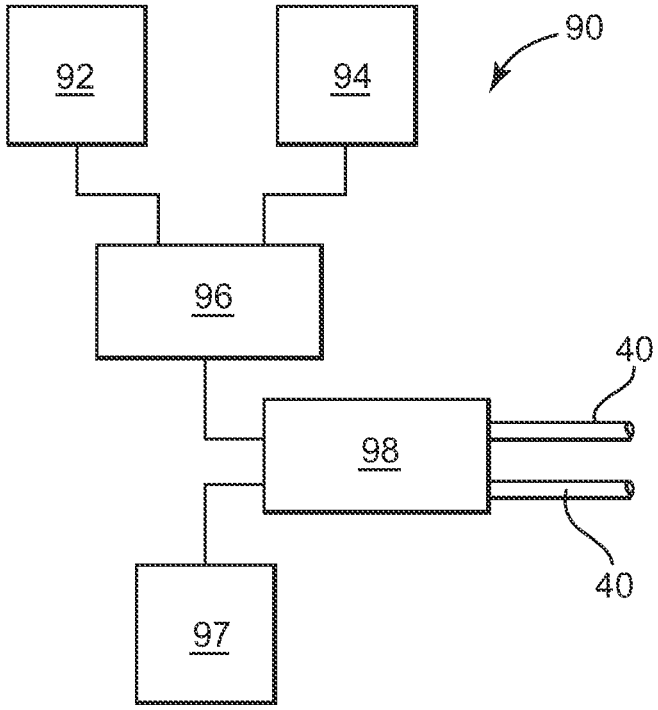
FIG. 5 is a schematic diagram of one system including a die according to the present invention.

FIG. 5 is a schematic diagram of one system 90 that may be used in connection with the present invention. The system 90 may preferably include polymer sources 92 and 94 that deliver polymer to an extruder 96. Although two polymer sources are depicted, it should be understood that only one polymer source may be provided in some systems. In addition, other systems may include three or more polymer sources. Furthermore, although only a single extruder 96 is depicted, it should be understood that system 90 may include any extrusion system or apparatus capable of delivering the desired polymer or polymers to the die 98 in accordance with the present invention.

The system 90 further includes a lubricant apparatus 97 operably attached to the die 98 to deliver lubricant to the die in accordance with the principles of the present invention. In some instances, the lubricant apparatus 97 may be in the form of a lubricant polymer source and extrusion apparatus.

Also depicted in connection with the system 90 are two fibers 40 being extruded from the die 98. Although two fibers 40 are depicted, it should be understood that only one fiber may be produced in some systems, while other systems may produce three or more polymer fibers at the same time.

Figure 6:
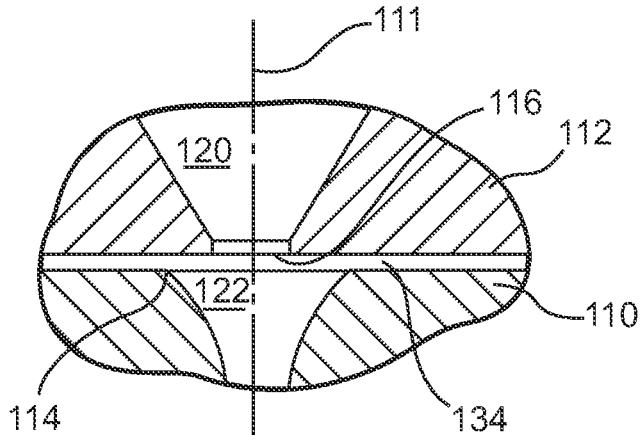
FIG. 6 is an enlarged cross-sectional view of another extrusion apparatus that may be used in connection with the present invention.

FIG. 6 depicts another exemplary embodiment of a die orifice that may be used in connection with the present invention. Only a portion of the apparatus is depicted in FIG. 6 to illustrate a potential relationship between the entrance 114 of the die orifice 122 and delivery of the lubricant through gap 134 between the die plate 110 and the die plate cover 112. In the depicted apparatus, the lubricant delivered separately from the polymer melt stream is introduced at the entrance 116 of the orifice 122 through gap 134. The polymer melt stream itself is delivered to the entrance 116 of the die orifice 122 through polymer delivery passage 120 in die plate cover 112.

Another optional relationship depicted in the exemplary apparatus of FIG. 6 is the relative size of the entrance 114 of the die orifice 122 as compared to the size of the opening 116 leading from the polymer delivery passage 120 into the entrance 114. It may be preferred that the cross-sectional area of the opening 116 be less than the cross-sectional area of the entrance 114 to the die orifice 122. As used herein, "cross-sectional area" of the openings is determined in a plane generally transverse to the longitudinal axis 111 (which is, preferably, the direction along which the polymer melt stream moves through the polymer delivery passage and the die orifice 122).

Figure 7:
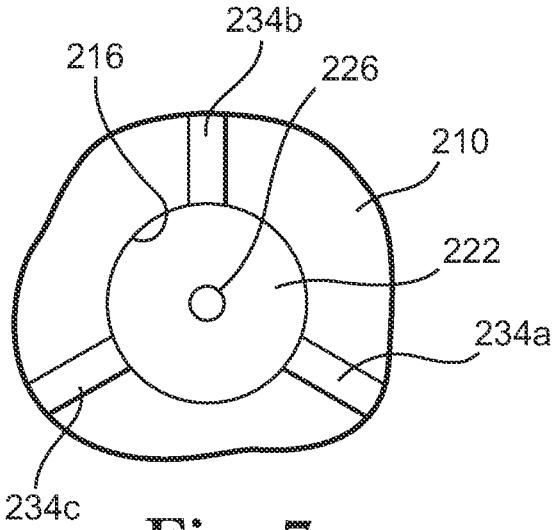
FIG. 7 is an enlarged plan view of another exemplary die orifice and lubrication channels that may be used in connection with the present invention.

FIG. 7 depicts yet another potential apparatus that may be used in connection with the present invention. FIG. 7 is an enlarged plan view of one die orifice 222 taken from above the die plate 210 (in a view similar to that seen in FIG. 4). The entrance 216 to the die orifice 222 is depicted along with the exit 226 of the die orifice 222. One difference between the design depicted in FIG. 7 and that depicted in the previous figures is that the lubricant is delivered to the die orifice 222 through multiple openings formed at the end of channels 234*a*, 234*b*, and 234*c*. This is in contrast to the continuous slot formed by the gap between the die plate and the die plate cover in the embodiments described above. Although three openings for delivering lubricant are depicted, it should be understood that as few as two and more than three such openings may be provided.

Figure 8:
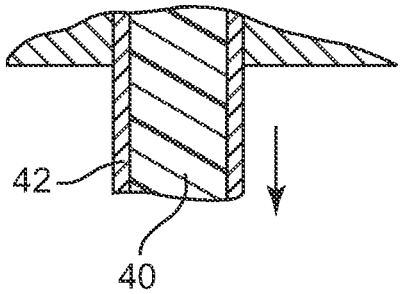
FIG. 8 is an enlarged cross-sectional view of one exemplary polymeric fiber exiting a die orifice in accordance with the methods of the present invention.

FIG. 8 depicts a flow of the polymer melt stream 40 and a lubricant 42 from the exit 26 of a die in accordance with the present invention. The polymer melt stream 40 and lubricant 42 are shown in cross-section, depicting the lubricant 42 on the outer surface 41 of the polymer melt stream 40. It may be preferred that the lubricant be provided on the entire outer surface 41 such that the lubricant 42 is located between the polymer melt stream 40 and the interior surface 23 of the die orifice.

Although the lubricant 42 is depicted on the outer surface 41 of the polymer melt stream 40 after the polymer melt stream 40 has left the orifice exit 26, it should be understood that, in some instances, the lubricant 42 may be removed from the outer surface 41 of the polymer melt stream 40 as or shortly after the polymer melt stream 40 and lubricant 42 leave the die exit 26.

Removal of the lubricant 42 may be either active or passive. Passive removal of the lubricant 42 may involve, e.g., evaporation, gravity or adsorbents. For example, in some instances, the temperature of the lubricant 42 and/or the polymer melt stream 40 may be high enough to cause the lubricant 42 to evaporate without any further actions after leaving the die exit 26. In other instances, the lubricant may be actively removed from the polymer melt stream 40 using, e.g., a water or another solvent, air jets, etc.

Depending on the composition of the lubricant 42, a portion of the lubricant 42 may remain on the outer surface 41 of the polymer melt stream 40. For example, in some instance the lubricant 42 may be a composition of two or more components, such as one or more carriers and one or more other components. The carriers may be, e.g., a solvent (water, mineral oil, etc.) that are removed actively or passively, leaving the one or more other components in place on the outer surface 41 of the polymer melt stream 40.

In other situations, the lubricant 42 may be retained on the outer surface 41 of the polymer melt stream 40. For example, the lubricant 42 may be a polymer with a viscosity that is low enough relative to the viscosity of the polymer melt stream 40 such that it can function as a lubricant during extrusion. Examples of potentially suitable polymers that may also function as lubricants may include, e.g., polyvinyl alcohols, high melt flow index polypropylenes, polyethylenes, etc.

Regardless of whether the lubricant 42 is removed from the surface 41 of the polymer melt stream 40 or not, the lubricant 42 may act as a quenching agent to increase the rate at which the polymer melt stream 40 cools. Such a quenching effect may help to retain particular desired structures in the polymer melt stream 40 such as orientation within the polymer melt stream 40. To assist in quenching, it may be desirable, for example, to provide the lubricant 42 to the die orifice at a temperature that is low enough to expedite the quenching process. In other instances, the evaporative cooling that may be provided using some lubricants may be relied on to enhance the quenching of the polymer melt stream 40. For example, mineral oil used as a lubricant 42 may serve to quench a polypropylene fiber as it evaporates from the surface of the polypropylene (the polymer melt stream) after exiting the die.

The present invention may preferably rely on a viscosity difference between the lubricant materials and the extruded polymer. Viscosity ratios of polymer to lubricant of, e.g., 40:1 or higher, or 50:1 or higher may preferably be a significant factor in selecting the lubricant to be used in connection with the methods of the present invention. The lubricant chemistry may be secondary to its rheological behavior. In this description, materials such as SAE 20 weight oil, white paraffin oil, and polydimethyl siloxane (PDMS) fluid are all examples of potentially suitable lubricant materials. The following list is not intended to be a limit on the lubricant candidates, i.e., other materials may be used as lubricants in connection with the present invention.

Non-limiting examples of inorganic or synthetic oils may include mineral oil, petrolatum, straight and branched chain hydrocarbons (and derivatives thereof), liquid paraffins and low melting solid paraffin waxes, fatty acid esters of glycerol, polyethylene waxes, hydrocarbon waxes, montan waxes, amide wax, glycerol monostearate. etc.

Many kinds of oils and fatty acid derivatives thereof may also be suitable lubricants in connection with the present invention. Fatty acid derivatives of oils can be used, such as, but not limited to, oleic acid, linoleic acid, and lauric acid. Substituted fatty acid derivatives of oils may also be used, such as, but not limited to, oleamide, propyl oleate and oleyl alcohol (it may be preferred that the volatility of such materials is not so high so as to evaporate before extrusion). Examples of some potentially suitable vegetable oils may include, but not limited to, apricot kernel oil, avocado oil, baobab oil, black currant oil, calendula officinalis oil, cannabis sativa oil, canola oil, chaulmoogra oil, coconut oil, corn oil, cottonseed oil, grape seed oil, hazelnut oil, hybrid sunflower oil, hydrogenated coconut oil, hydrogenated cottonseed oil, hydrogenated palm kernel oil, jojoba oil, kiwi seed oil, kukui nut oil, macadamia nut oil, mango seed oil, meadowfoam seed oil, mexican poppy oil, olive oil, palm kernel oil, partially hydrogenated soybean oil, peach kernel oil, peanut oil, pecan oil, pistachio nut oil, pumpkin seed oil, quinoa oil, rapeseed oil, rice bran oil, safflower oil, sasanqua oil, sea buckthorn oil, sesame oil, shea butter fruit oil, sisymbrium irio oil, soybean oil, sunflower seed oil, walnut oil, and wheat germ oil.

Other potentially suitable lubricant materials may include, e.g., saturated aliphatic acids including hexanoic acid, caprylic acid, decanoic acid, undecanoic acid, lauric acid, myristic acid, palmitic acid and stearic acid, unsaturated aliphatic acids including oleic acid and erucic acid, aromatic acids including benzoic acid, phenyl stearic acid, polystearic acid and xylyl behenic acid and other acids including branched carboxylic acids of average chain lengths of 6, 9, and 11 carbons, tall oil acids and rosin acid, primary saturated alcohols including 1-octanol, nonyl alcohol, decyl alcohol, 1-decanol, 1-dodecanol, tridecyl alcohol, cetyl alcohol and 1-heptadecanol, primary unsaturated alcohols including undecylenyl alcohol and oleyl alcohol, secondary alcohols including 2-octanol, 2-undecanol, dinonyl carbinol and diundecyl carbinol and aromatic alcohols including 1-phenyl ethanol, 1-phenyl-1-pentanol, nonyl phenyl, phenylstearyl alcohol and 1-naphthol. Other potentially useful hydroxyl-containing compounds may include polyoxyethylene ethers of oleyl alcohol and a polypropylene glycol having a number average molecular weight of about 400. Still further potentially useful liquids may include cyclic alcohols such as 4, t-butyl cyclohexanol and methanol, aldehydes including salicyl aldehyde, primary amines such as octylamine, tetradecylamine and hexadecylamine, secondary amines such as bis-(1-ethyl-3-methyl pentyl) amine and ethoxylated amines including N-lauryl diethanolamine, N-tallow diethanolamine, N-stearyl diethanolamine and N-coco diethanolamine.

Additional potentially useful lubricant materials may include aromatic amines such as N-sec-butylaniline, dodecylaniline, N,N-dimethylaniline, N,N-diethylaniline, p-toluidine, N-ethyl-o-toluidine, diphenylamine and aminodiphenylmethane, diamines including N-erucyl-1,3-propane diamine and 1,8-diamino-p-methane, other amines including branched tetramines and cyclodecylamine, amides including cocoamide, hydrogenated tallow amide, octadecylamide, eruciamide, N,N-diethyl toluamide and N-trimethylopropane stearamide, saturated aliphatic esters including methyl caprylate, ethyl laurate, isopropyl myristate, ethyl palmitate, isopropyl palmitate, methyl stearate, isobutyl stearate and tridecyl stearate, unsaturated esters including stearyl acrylate, butyl undecylenate and butyl oleate, alkoxy esters including butoxyethyl stearate and butoxyethyl oleate, aromatic esters including vinyl phenyl stearate, isobutyl phenyl stearate, tridecyl phenyl stearate, methyl benzoate, ethyl benzoate, butyl benzoate, benzyl benzoate, phenyl laurate, phenyl salicylate, methyl salicylate and benzyl acetate and diesters including dimethyl phenylene distearate, diethyl phthalate, dibutyl phthalate, di-iso-octyl phthalate, dicapryl adipate, dibutyl sebacate, dihexyl sebacate, di-iso-octyl sebacate, dicapryl sebacate and dioctyl maleate. Yet other potentially useful lubricant materials may include polyethylene glycol esters including polyethylene glycol (which may preferably have a number of average molecular weight of about 400), diphenylstearate, polyhydroxylic esters including castor oil (triglyceride), glycerol monostearate, glycerol monooleate, glycol distearate glycerol dioleate and trimethylol propane monophenylstearate, ethers including diphenyl ether and benzyl ether, halogenated compounds including hexachlorocyclopentadiene, octabromobiphenyl, decabromodiphenyl oxide and 4-bromodiphenyl ether, hydrocarbons including 1-nonene, 2-nonene, 2-undecene, 2-heptadecene, 2-nonadecene, 3-eicosene, 9-nonadecene, diphenylmethane, triphenylmethane and trans-stilbene, aliphatic ketones including 2-heptanone, methyl nonyl ketone, 6-undecanone, methylundecyl ketone, 6-tridecanone, 8-pentadecanone, 11-pentadecanone, 2-heptadecanone, 8-heptadecanone, methyl heptadecyl ketone, dinonyl ketone and distearyl ketone, aromatic ketones including acetophenone and benzophenone and other ketones including xanthone. Still further potentially useful lubricants may include phosphorous compounds including trixylenyl phosphate, polysiloxanes, Muget hyacinth (An Merigenaebler, Inc), Terpineol Prime No. 1 (Givaudan-Delawanna, Inc), Bath Oil Fragrance #5864 K (International Flavor & Fragrance, Inc), Phosclere P315C (organophosphite), Phosclere P576 (organophosphite), styrenated nonyl phenol, quinoline and quinalidine.

Oils with emulsifier qualities may also potentially be used as lubricant materials, such as, but not limited to, neatsfoot oil, neem seed oil, PEG-5 hydrogenated castor oil, PEG-40 hydrogenated castor oil, PEG-20 hydrogenated castor oil isostearate, PEG-40 hydrogenated castor oil isostearate, PEG-40 hydrogenated castor oil laurate, PEG-50 hydrogenated castor oil laurate, PEG-5 hydrogenated castor oil triisostearate, PEG-20 hydrogenated castor oil triisostearate, PEG-40 hydrogenated castor oil triisostearate, PEG-50 hydrogenated castor oil triisostearate, PEG-40 jojoba oil, PEG-7 olive oil, PPG-3 hydrogenated castor oil, PPG-12-PEG-65 lanolin oil, hydrogenated mink oil, hydrogenated olive oil, lanolin oil, maleated soybean oil, musk rose oil, cashew nut oil, castor oil, dog rose hips oil, emu oil, evening primrose oil, and gold of pleasure oil.

Test Methods

Modulus:

The moduli of the fibers of the invention were measured using the procedures described in ASTM-D2653-01. 16 mm diameter roller grips (MTS 100-034-764) were used with a 14 cm grip separation and a crosshead speed of 25.4 cm/min. A 500 N load cell was used. The diameters of the fibers were measured using an Ono Sokki thickness gauge. 5 replicates were run and averaged.

Mass Flow Rate:

The mass flow rate was measured by a basic gravimetric method. The exiting extrudate was captured in a pre-weighed aluminum tray for a period of 80 seconds. The difference between the total weight and the weight of the tray was measured in grams or kilograms and is reported in grams/minute or kilograms/hour.

Melf Flow Index (MFI):

The melt flow indices of the polymers were measured according to ASTM D1238 at the conditions specified for the given polymer type.

Surface Roughness:

The surfaces of fibers produced according to some of the examples described herein were characterized using a Wyko NT3300 optical profiler (Veeco Instruments, Inc., Woodbury, N.Y.) operating in VSI mode. Before testing, the fiber samples were rinsed in heptane to remove lubricant left on the fiber surface from manufacturing and sputter-coated (210 s Pt sputter coat) to enhance reflectivity. At least three samples were tested from each fiber with the results for each sample reported in Table 1. Fiber samples from the fiber of Example 6 showed obvious reaction with heptane and were not tested. Fiber samples from the fiber of the comparative example were not rinsed in heptane, but were sputter-coated as described above.

The optical profiler was set to obtain an image size of 188 micrometers (μm) wide by 247 μm long along the length of the fiber (with the exception of the fiber of Example 5 in which the image length was 239 μm). The data was cylindrically-fitted as provided for in optical profiler to produce a flat image for measurement purposes. In addition, the width of the image was cropped to remove the data obtained from the steepest sides of the fiber, with the width of the resulting image used to collect the data reported with the calculated roughness values in Table 1. The values were calculated using Veeco Vision software (Version 3.44) in connection with the Wyko NT3300 optical profiler The calculated roughness values are reported in Table 1 (as calculated using Veeco Vision software in combination with the Wyko NT3300 optical profiler), with the following values being reported (in addition to image width).

Ra is the average roughness which is the main height as calculated over the entire measured area (per ANSI B46.1 standard) using the following equation (where M and N equal the number of data points in X and Y and Z is the surface height relative to the mean surface).

$$Ra = \frac{1}{MN}\sum_{j=1}^{N}\sum_{i=1}^{M}|Zij|$$

Rq is the root-mean-square (rms) roughness between the height deviations and the mean surface taken over the evaluation area.

$$Rq = \sqrt{\frac{1}{MN}\sum_{j=1}^{N}\sum_{i=1}^{M}Z^2(x_i, y_j)}$$

Rz is the average maximum profile of the ten greatest peak to valley separations in the evaluation area (the software excludes an 11×11 region around each high (H) or low (L) point such that all peak or valley points do not emanate from a single spike or hole).

$$Rz = \frac{1}{10}\left[\sum_{i=1}^{10}H_i - \sum_{j=1}^{10}L_j\right]$$

Rp is the maximum profile peak height, i.e., the maximum height difference between the mean surface and the highest point within the evaluation area.

Rv is the maximum profile valley depth, i.e., the distance between the lowest point of the profile and the mean surface within the evaluation area.

Rt is the vertical distance between the maximum profile peak height (Rp) and the maximum profile valley depth (Rv) within the evaluation area (Rt=Rp+Rv).

Rsk is a measure of the skewness or asymmetry of the profile about the mean surface (where negative skew indicates a predominance of valleys, while positive skew is seen on surfaces with a predominance of peaks).

$$Rsk = \frac{1}{nRq^3}\sum_{i=1}^{n}(Z_i - \overline{Z})^3$$

Rvm is the average of the profile valley depth (Rv) within the evaluation area.

Rpm is the average of the profile peak height (Rm) within the evaluation area.

TABLE 1

| Ex. No. - Sample | Width (μm) | Ra (nm) | Rq (nm) | Rz (μm) | Rt (μm) | Rv (μm) | Rvm (μm) | Rp (μm) | Rpm (μm) | Rsk |
|---|---|---|---|---|---|---|---|---|---|---|
| 1-1 | 122 | 215 | 270 | 2.30 | 2.73 | −1.37 | −1.15 | 1.36 | 1.15 | −0.12 |
| 1-2 | 123 | 217 | 274 | 2.35 | 2.71 | −1.45 | −1.21 | 1.26 | 1.14 | −0.18 |
| 1-3 | 128 | 159 | 203 | 2.14 | 4.19 | −1.20 | −0.95 | 2.99 | 1.19 | 0.02 |
| 5-1 | 106 | 389 | 488 | 3.68 | 4.49 | −2.09 | −1.80 | 2.40 | 1.88 | 0.05 |
| 5-2 | 111 | 436 | 561 | 5.23 | 6.70 | −2.77 | −2.31 | 3.92 | 2.92 | 0.18 |
| 5-3 | 106 | 480 | 585 | 4.37 | 5.13 | −2.17 | −1.88 | 2.97 | 2.50 | 0.09 |
| 5-4 | 110 | 394 | 499 | 4.47 | 5.83 | −2.22 | −1.91 | 3.61 | 2.56 | 0.25 |
| 7-1 | 109 | 227 | 274 | 2.53 | 3.09 | −1.02 | −0.83 | 2.07 | 1.70 | −0.13 |
| 7-2 | 104 | 246 | 295 | 3.29 | 4.23 | −1.18 | −1.00 | 3.04 | 2.30 | 0.14 |
| 7-3 | 132 | 330 | 374 | 1.88 | 2.11 | −1.11 | −0.95 | 1.00 | 0.93 | 0.31 |
| 8-1 | 128 | 131 | 167 | 1.50 | 2.36 | −0.65 | −0.56 | 1.72 | −0.94 | 0.71 |
| 8-2 | 129 | 191 | 238 | 3.56 | 5.73 | −1.25 | −0.78 | 4.48 | 2.78 | 1.85 |
| 8-3 | 130 | 119 | 145 | 1.26 | 1.73 | −0.67 | −0.57 | 1.06 | 0.70 | 0.02 |
| 10-1 | 124 | 331 | 411 | 2.99 | 3.33 | −1.57 | −1.49 | 1.75 | 1.50 | 0.10 |
| 10-2 | 113 | 164 | 204 | 2.01 | 2.71 | −0.98 | −0.72 | 1.73 | 1.29 | 0.31 |

TABLE 1-continued

| Ex. No. - Sample | Width (μm) | Ra (nm) | Rq (nm) | Rz (μm) | Rt (μm) | Rv (μm) | Rvm (μm) | Rp (μm) | Rpm (μm) | Rsk |
|---|---|---|---|---|---|---|---|---|---|---|
| 10-3 | 121 | 415 | 526 | 4.80 | 6.30 | −2.46 | −2.08 | 3.85 | 2.72 | 0.07 |
| 12-1 | 112 | 228 | 296 | 3.04 | 3.96 | −2.12 | −1.65 | 1.83 | 1.38 | −0.19 |
| 12-2 | 120 | 215 | 281 | 2.95 | 3.55 | −1.78 | −1.58 | 1.77 | 1.37 | −0.20 |
| 12-3 | 114 | 167 | 220 | 2.76 | 4.79 | −1.63 | −1.43 | 3.17 | 1.33 | −0.62 |
| 13-1 | 107 | 230 | 289 | 2.63 | 4.25 | −2.87 | −1.40 | 1.38 | 1.22 | −0.07 |
| 13-2 | 118 | 211 | 278 | 3.41 | 5.00 | −1.64 | −1.36 | 3.37 | 2.05 | 0.20 |
| 13-3 | 113 | 480 | 581 | 3.83 | 4.70 | −2.25 | −1.80 | 2.44 | 2.03 | 0.10 |
| Comp.-1 | 126 | 2140 | 2840 | 18.6 | 20.5 | −13.2 | −11.5 | 7.31 | 7.11 | −0.15 |
| Comp.-2 | 104 | 1705 | 2670 | 30.3 | 40.1 | −20.1 | −12.0 | 20.0 | 18.3 | −0.90 |
| Comp.-3 | 113 | 1248 | 1680 | 12.4 | 14.7 | −7.55 | −7.15 | 7.15 | 5.29 | −0.80 |

EXAMPLES

The following non-limiting examples are provided to illustrate the principles of the present invention.

Example 1

A polymeric fiber was produced using apparatus similar to that shown in FIG. 5. A single orifice die as shown in FIG. 6 was used. The die orifice was circular and had an entrance diameter of 1.68 mm, an exit diameter of 0.76 mm, a length of 12.7 mm and a semi-hyperbolic shape defined by the equation:

$$r_z=[0.00140625/((0.625*z)+0.0625)]^{0.5} \quad (9)$$

where z is the location along the axis of the orifice as measured from the entrance and $r_z$ is the radius at location z.

Polypropylene homopolymer (FINAPRO 5660, 9.0 MFI, Atofina Petrochemical Co., Houston, Tex.) was extruded with a 3.175 cm single screw extruder (30:1 L/D) using a barrel temperature profile of 177° C.-232° C.-246° C. and an in-line ZENITH gear pump (1.6 cubic centimeters/revolution (cc/rev)) set at 19.1 RPM. The die temperature and melt temperature were approximately 220° C. Chevron SUPERLA white mineral oil #31 as a lubricant was supplied to the entrance of the die using a second ZENITH gear pump (0.16 cc/rev) set at 30 RPM.

The molten polymer pressure and corresponding mass flow rate of the extrudate are shown in Table 1 below. The pressure transducer for the polymer was located in the feed block just above the die at the point where the polymer was introduced to the die. The lubricant pressure transducer was located in the lubricant delivery feed line prior to introduction to the die. A control sample was also run without the use of lubricant.

Example 2

A polymeric fiber was produced as in Example 1 except that a die similar to that depicted in FIG. 2 was used. The die orifice had a circular profile with an entrance diameter of 6.35 mm, an exit diameter of 0.76 mm, a length of 10.16 mm and a semi-hyperbolic shape defined by Equation (8) as described herein.

Molten polymer pressure and mass flow rate of the extrudate are shown in Table 2 below with and without lubricant.

Example 3

A polymeric fiber was produced as in Example 1 except that a die as shown in FIG. 2 was used. The die orifice had a circular profile with an entrance diameter of 6.35 mm, an exit diameter of 0.51 mm, a length of 12.7 mm and a semi-hyperbolic shape defined by Equation (8).

Polyurethane (PS440-200 Huntsman Chemical, Salt Lake City, Utah) was used to form the fiber. The polymer was delivered with a 3.81 cm single screw extruder (30:1 L/D) using a barrel temperature profile of 177° C.-232° C.-246° C. and an in-line ZENITH gear pump (1.6 cc/rev) set at 19.1 RPM. The die temperature and melt temperature was approximately 215° C. Chevron SUPERLA white mineral oil #31 as a lubricant was supplied to the entrance of the die via two gear pumps in series driven at 99 RPM and 77 RPM respectively. Molten polymer pressure and mass flow rate of the extrudate is shown in Table 1 below. A control sample was also run without the use of lubricant.

TABLE 2

| Example | Melt Pressure ($kg/cm^2$) | Mass Flow Rate (grams/min) |
|---|---|---|
| 1 | 8.8-17.6 | 33.9 |
| Control w/o lub. | 8.8-17.6 | 4.1 |
| 2 | 6.3-8.4 | 106 |
| Control w/o lub. | 52.8 | 94 |
| 3 | 5.3 | 45 |
| Control w/o lub. | 114 | 22.7 |

Table 2 shows that at similar melt pressures, substantially higher mass flow rates may be obtained using the invention process (Example 1), and at similar mass flow rates, polymer may be extruded at significantly lower pressures (Example 2). As seen in Example 3, melt pressure may be significantly reduced and mass flow rate substantially increased simultaneously when using the invention process.

Example 4

A polymeric fiber was produced using the die of Example 1. High molecular weight polyethylene (Type 9640, 0.2 MI, Chevron Phillips Chemical Co., Houston, Tex.) was extruded with a 38 mm single screw extruder (30:1 L/D, 9 RPM) using a barrel temperature profile of 177° C.-200° C.-218° C. and an in-line ZENITH gear pump (1.6 cubic centimeters/revolution (cc/rev)) set at 3.7 RPM. The die temperature and melt temperature were approximately 218° C. Chevron SUPERLA white mineral oil #31 (Chevron USA Inc., Houston, Tex.) as a lubricant was supplied to the entrance of the die using a ZENITH dual gear single feed gear pump (0.16 cc/rev) set at 80 RPM. The extruded fiber was collected at the die exit manually and coiled by hand.

The molten polymer pressure varied between 241 $N/cm^2$ (350 $lbs/in^2$) and 550 $N/cm^2$ (798 $lbs/in^2$) at a mass flow rate of 2.0-2.5 kg/hr (4.5-5.5 lbs/hr). The pressure transducer for the polymer was located in the feed block just above the die at the point where the polymer was introduced to the die. The lubricant pressure transducer was located in the lubricant delivery feed line prior to introduction to the die.

Example 5

A polymeric fiber was produced as in Example 1. The die orifice had a circular profile with an entrance diameter of 6.35 mm, an exit diameter of 0.76 mm, a length of 127 mm and a semi-hyperbolic shape defined by Equation (8) as described herein. A high molecular weight fractional melt index polyethylene (HD7960.13, 0.06 MI, ExxonMobil Chemical Inc., Houston, Tex.) was extruded using a 19 mm single screw (30:1 L/D, 12 RPM) extruder using a barrel temperature profile of 270° C.-255° C.-240° C. fitted with a 0.16 cubic centimeters per revolution (0.16 cc/rev) gear pump operating at 6 RPM. The die temperature and melt temperature were approximately 218° C. Chevron SUPERLA white mineral oil #31 (Chevron USA Inc., Houston, Tex.) as a lubricant was supplied to the entrance of the die using a Lorimer "air over oil" pneumatic high pressure pump (H. Lorimer Corp., Longview, Tex.).

The extruded fiber was then quenched in a water bath (approximately 20° C.) positioned approximately 5 cm beneath the die exit at a rate of 15 meter/min. The fiber was then length oriented in-line between two pull rolls by immersing the fiber in a hot water bath (79° C.) with a draw ratio between the two pull rolls of approximately 9:1. The oriented fiber was then run over a heated platen set at 177° C. to relax (heat set) the fiber and then wound onto a core.

The average fiber diameter was 0.305 mm. The modulus of the fiber was measured to be 205 kN/cm$^2$ with a break tensile force of 46 kN.

Example 6

A polymeric fiber was produced as in Example 1 except a high molecular weight elastomeric polyethylene (ENGAGE 8100, 1.0 MI, Dow Chemical Co., Midland, Mich.) was used to form the fiber. The polymer was delivered with a 38 mm single screw extruder (32:1 L/D, 14 RPM) using a barrel temperature profile of 177° C.-200° C.-218° C. and an in-line ZENITH gear pump (1.6 cc/rev) set at 8 RPM resulting in a polymer flow rate of approximately 2.4 kg/hr. The die temperature and melt temperature was approximately 218° C. Chevron SUPERLA white mineral oil #31 as a lubricant was supplied to the entrance of the die using a ZENITH dual gear single feed gear pump (0.16 cc/rev) set at 75 RPM. The extruded fiber was collected at the die exit manually and coiled by hand.

Example 7

A polymeric fiber was produced as in Example 1 except an amorphous glassy polycarbonate (MACROLON 2407, Bayer Chemical Co., Leverkusen, Germany) was used to form the fiber. The polymer was delivered with a 38 mm single screw extruder (32:1 L/D, 14 RPM) using a barrel temperature profile of 177° C.-200° C.-229° C. and an in-line ZENITH gear pump (1.6 cc/rev) set at 8 RPM resulting in a polymer flow rate of approximately 2.4 kg/hr. The die temperature and melt temperature was approximately 229° C. Chevron SUPERLA white mineral oil #31 as a lubricant was supplied to the entrance of the die using a ZENITH dual gear single feed gear pump (0.16 cc/rev) set at 75 RPM. The extruded fiber was collected at the die exit manually and coiled by hand.

Example 8

A polymeric fiber was produced as in Example 7 except a glassy polymer (VO45 PMMA Glass P-7B, Rohm & Haas) was used in place of the polycarbonate used in Example 7.

Example 9

A polymeric fiber was produced as in Example 5 except that a nylon-6 polyamide (ULTRAMID B4, BASF Corp., Wyandotte, Mich.) was extruded using a 19 mm single screw (30:1 L/D, 18 RPM) extruder using a barrel temperature profile of 250° C.-300° C.-300° C. fitted with a 0.16 cubic centimeters per revolution (0.16 cc/rev) gear pump operating at 8 RPM. The die temperature and melt temperature were approximately 260° C. Chevron SUPERLA white mineral oil #31 (Chevron USA Inc., Houston, Tex.) as a lubricant was supplied to the entrance of the die using a Lorimer "air over oil" pneumatic high pressure pump (H. Lorimer Corp., Longview, Tex.). A 3 mm diameter (ID) copper tubing was used to supply the lubricant from the pump to the die. The tubing was wrapped 2.5 times around the 7.6 cm diameter die prior to the entry port into the die. This was done to heat the temperature of the lubricant up to that of the die.

The extruded fiber with a diameter of approximately 1 millimeter was then quenched in a water bath (approximately 20° C.) positioned approximately 2.5 cm beneath the die exit at a rate of 2.4 meter/min. The fiber was then length oriented in-line between two pull rolls by immersing the fiber in a hot water bath (79° C.) with a draw ratio between the two pull rolls of approximately 4:1. The oriented fiber was then run over a heated platen set at 177° C. to relax (heat set) the fiber and then over a second heated platen set at 121° C. to anneal the fiber and then wound onto a core. The modulus of the fiber was measured to be 226 kN/cm$^2$.

Example 10

A polymeric fiber was produced as in Example 9 except a nylon-6 polyamide (ULTRAMID B3, BASF Corp., Wyandotte, Mich.) was used in place of the nylon-6 polyamide used in Example 9.

Example 11

A polymeric fiber was produced as in Example 9 except that significantly lower process temperatures were used to obtain a melt temperature slightly above the polymer melting point (230° C.) resulting in significantly higher modulus fibers. The nylon was extruded using a barrel temperature profile of 240° C.-250° C.-240° C. The melt pump was set at 235° C., the die feed block at 230° C. and the die at 225° C. The modulus of the fiber was measured to be 765 kN/cm$^2$.

Example 12

A polymeric fiber was produced as in Example 1 except two extruders were used to feed two materials to a sheath/core feedblock resulting in a bicomponent coextruded fiber. Polypropylene homopolymer (FINAPRO 5660, 9.0 MFI, Atofina Petrochemical Co., Houston, Tex.) was used to form the core of the fiber. The polymer was delivered with a 25 mm single screw extruder (24:1 L/D) using a barrel temperature profile of 177° C.-200° C.-232° C. and an in-line ZENITH gear pump (1.6 cc/rev) set at 24 RPM. FINAPRO 5660 pigmented with 2% orange color concentrate (Type 66Y163, Penn Color Co., Doylestown, Pa.) was used to form the sheath of the fiber. The polymer was delivered with a 19 mm single screw extruder using a barrel temperature profile of 177° C.-195° C.-215° C.-232° C. and an in-line ZENITH gear pump (1.6 cc/rev) set at 24 RPM. The melt pump was set at 232° C., the die feed block at 232° C. and the die at 232° C. The die feed block consisted of a series of 0.5 mm thick machined plates stacked to provide a dual feed plate die as is well known in the art of coextruded fibers.

The lubricant introduction manifold was attached at the bottom of the plate stack. Universal Trans Hydraulic oil (Mills Fleet Farm Inc., Brainerd, Minn.) was used as the lubricant and was supplied to the entrance of the die using a ZENITH dual gear single feed gear pump (0.16 cc/rev) set at 80 RPM. The extruded fiber was collected at the die exit manually and coiled by hand.

Example 13

A polymeric fiber was produced as in Example 1 except a multiphase acrylonitrile-styrene-butylacrylate polymer (CENTREX 833, Marine White, 3 MFI, Bayer Corp., Leverkusen, Germany) was used to form the fiber. The polymer was delivered with a 38 mm single screw extruder (32:1 L/D, 14 RPM) using a barrel temperature profile of 177° C.-200° C.-218° C. and an in-line ZENITH gear pump (1.6 cc/rev) set at 8 RPM resulting in a polymer flow rate of approximately 2.4 kg/hr. The die temperature and melt temperature was approximately 218° C. Chevron SUPERLA white mineral oil #31 as a lubricant was supplied to the entrance of the die using a ZENITH dual gear single feed gear pump (0.16 cc/rev) set at 75 RPM. The extruded fiber was collected at the die exit manually and coiled by hand.

Comparative Example

A sample of FIRELINE fishing line available from Berkley, Spirit Lake, Iowa was obtained for testing ("SMOKE" 6 pound test). This line is a gel spun fiber of an ultra high molecular weight polyethylene.

As used herein and in the appended claims, the singular forms "a," "and," and "the" include plural referents unless the context clearly dictates otherwise. Thus, for example, reference to "a fiber" may include a plurality of fibers and reference to "the orifice" may encompass one or more orifices and equivalents thereof known to those skilled in the art.

All references and publications cited herein are expressly incorporated herein by reference in their entirety into this disclosure. Illustrative embodiments of this invention are discussed and reference has been made to possible variations within the scope of this invention. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

The invention claimed is:

1. A melt extruded polymeric fiber comprising one or more polymers, and a lubricant provided on an entire outer surface of the fiber, wherein:

(a) all polymers of which the fiber is comprised exhibit a melt flow index of less than 1 g/10 min measured at the condition specified for each of the one or more polymers by ASTM D 1238, and said polymers are selected from the group consisting of: ultra high molecular weight polyethylene, polypropylene, polycarbonates, styrenic block copolymers, ABS (acrylonitrile, butadiene, styrene copolymers), ethylene-propylene-nonconjugated diene copolymers grafted with a mixture of styrene and acrylonitrile (AES), styrene-acrylonitrile (SAN) copolymers, polyimides, norbornenes, polyphenylene sulfide, ionomers, polyesters, polyamides, polyurethanes, oriented syndiotactic polystyrene, acrylonitrile-styrene-acrylonitrile (ASA) copolymers; styrene-acrylonitrile copolymers, acrylonitrile-styrene-butylacrylate polymer, and multiphase polymers comprising macromolecules composed of different species that form separate phases within the same mass of material or a blend of one or more such polymers and one or more thermoplastic polymer;

(b) the lubricant has a viscosity, at the temperature at which the polymer is delivered to the extrusion die from which the fiber was extruded, that has a ratio to the polymer viscosity at the same temperature of 1:40 or less;

(c) the fiber comprises a continuous length at least 1000 times its width; and (d) the fiber has an average roughness (Ra) of about 1000 nanometers or less.

2. A fiber according to claim 1, wherein the fiber has an average roughness (Ra) of about 500 nanometers or less.

3. A fiber according to claim 1, wherein the fiber has a root-mean-square roughness (Rq) of about 1000 nanometers or less.

4. A fiber according to claim 1, wherein the fiber has a root-mean-square roughness (Rq) of about 500 nanometers or less.

5. A melt extruded polymeric fiber comprising one or more polymers, and a lubricant on the entire outer surface of the fiber, wherein:

(a) all polymers of which the fiber is comprised exhibit a melt flow index of 0.1 g/10 min or less measured at the conditions specified for each of the one or more polymers by ASTM D1238, and said polymers are selected from the group consisting of: ultra high molecular weight polyethylene, polypropylene, polycarbonates, ABS (acrylonitrile, butadiene, styrene copolymers), ethylene-propylene-nonconjugated diene copolymers grafted with a mixture of styrene and acrylonitrile (AES), styrene-acrylonitrile (SAN) copolymers, polyimides, norbornenes, polyphenylene sulfide, ionomers, polyesters, polyamides, polyurethanes, oriented syndiotactic polystyrene, acrylonitrile-styrene-acrylonitrile (ASA) copolymers; styrene-acrylonitrile copolymers, acrylonitrile-styrene-butylacrylate polymer, and multiphase polymers comprising macromolecules composed of different species that form separate phases within the same mass of material or a blend of one or more such polymers and one or more thermoplastic polymer;

(b) the lubricant has a viscosity, at the temperature at which the polymer is delivered to the extrusion die from which the fiber was extruded, that has a ratio to the polymer viscosity at the same temperature of 1:40 or less; and (c) the fiber has a length at least 1000 times its width and has an average roughness (Ra) of about 1000 nanometers or less.

6. A fiber according to claim 1, wherein one of the one or more polymers comprises a bulk polymer, wherein the bulk polymer is a majority of the volume of the fiber.

7. A fiber according to claim 6, wherein the bulk polymer is a glassy polymer or a semicrystalline polymer.

8. A fiber according to claim 7, wherein the bulk polymer is a glassy polymer selected from the group consisting of polymethylmethacrylates, polystyrenes, polycarbonates, and polyvinylchlorides.

9. A fiber according to claim 7, wherein the bulk polymer is a semicrystalline polymer selected from the group consisting of polyethylene, polypropylene, and polyester.

10. A fiber according to claim 1, wherein all of the one or more polymers are rubbery polymers selected from the group consisting of polyurethanes and styrenic block copolymers.

11. A melt extruded polymeric fiber comprising one or more polymers, and a lubricant provided on an entire outer surface of the fiber, wherein:

(a) all polymers of which the fiber is comprised have a melt flow index of less than 1 g/10 min measured at the condition specified for each of the one or more polymers by ASTM D 1238, and said polymers are selected from the group consisting of: ultra high molecular weight polyethylene, polypropylene, polycarbonates, ABS (acrylonitrile, butadiene, styrene copolymers), ethylene-propylene-nonconjugated diene copolymers grafted with a mixture of styrene and acrylonitrile (AES), styrene-acrylonitrile (SAN) copolymers, polyimides, norbornenes, polyphenylene sulfide, ionomers, polyesters, polyamides, polyurethanes, oriented syndiotactic polystyrene, acrylonitrile-styrene-acrylonitrile (ASA) copolymers; styrene-acrylonitrile copolymers, acrylonitrile-styrene-butylacrylate polymer, and multiphase polymers comprising macromolecules composed of different species that form separate phases within the same mass of material or a blend of one or more such polymers and one or more thermoplastic polymer;

(b) the lubricant has a viscosity, at the temperature at which the polymer is delivered to the extrusion die from which the fiber was extruded, that has a ratio to the polymer viscosity at the same temperature of 1:40 or less; and (c) the fiber has a length at least 1000 times its width, an average roughness (Ra) of about 1000 nanometers or less, and does not comprise an antistatic agent.

* * * * *

UNITED STATES PATENT AND TRADEMARK OFFICE

CERTIFICATE OF CORRECTION

PATENT NO. : 8,481,157 B2
APPLICATION NO. : 11/668687
DATED : July 9, 2013
INVENTOR(S) : Bruce B. Wilson et al.

It is certified that error appears in the above-identified patent and that said Letters Patent is hereby corrected as shown below:

In the Specification:

Column 11

Line 50, delete "to experienced" and insert in place thereof -- to be experienced --

Column 16

Line 2, delete "cocoamide," and insert in place thereof -- cocamide, --

Line 3, delete "eruciamide," and insert in place thereof -- erucamide, --

Line 3, delete "trimethylopropane" and insert in place thereof -- trimethylolpropane --

Line 39, delete "Muget" and insert in place thereof -- Muguet --

Line 44, delete "quinalidine" and insert in place thereof -- quinaldine --

Signed and Sealed this
Twelfth Day of November, 2013

Teresa Stanek Rea

Teresa Stanek Rea
*Deputy Director of the United States Patent and Trademark Office*